United States Patent [19]

Hansen et al.

[11] Patent Number: 4,460,885

[45] Date of Patent: Jul. 17, 1984

[54] POWER TRANSFORMER

[75] Inventors: Irvin L. Hansen, Muncie; Leach S. McCormick, Yorktown; Harold R. Moore, Mount Pleasant Twp., Delaware County, all of Ind.

[73] Assignee: Westinghouse Electric Corp., Pittsburgh, Pa.

[21] Appl. No.: 287,844

[22] Filed: Jul. 29, 1981

[51] Int. Cl.[3] ..... H01F 27/28

[52] U.S. Cl. ..... 336/180; 336/182; 336/183; 336/187; 336/186

[58] Field of Search ..... 336/180, 182, 183, 187, 336/186

[56] References Cited

U.S. PATENT DOCUMENTS

| | | | |
|---|---|---|---|
| 716,206 | 12/1902 | Dolezalek | 336/186 X |
| 2,878,455 | 3/1959 | Lamberton et al. | 336/180 X |
| 3,153,216 | 10/1964 | Klitten | 336/233 |
| 3,688,233 | 8/1972 | Moore et al. | 336/187 |
| 3,939,449 | 2/1976 | Boyd et al. | 336/183 |

FOREIGN PATENT DOCUMENTS

| | | | |
|---|---|---|---|
| 1198126 | 12/1959 | France | 336/186 |

*Primary Examiner*—J. V. Truhe
*Assistant Examiner*—Susan Steward
*Attorney, Agent, or Firm*—L. P. Johns

[57] ABSTRACT

A power transformer characterized by inner and outer low voltage winding sections and a high voltage winding section disposed therebetween. The low voltage windings are comprised of a plurality of pancake coils, and the high voltage winding are comprised of a plurality of conductor strands spirally wound for a plurality of coil layers. The low and high voltage winding sections are laterally spaced with the low voltage windings disposed in side-by-side positions and adjacent to the high voltage windings. The high voltage windings having a smaller turn height than the low voltage windings and having conductor strands of smaller gauge than the pancake coils of the low voltage windings.

2 Claims, 3 Drawing Figures

FIG. 2
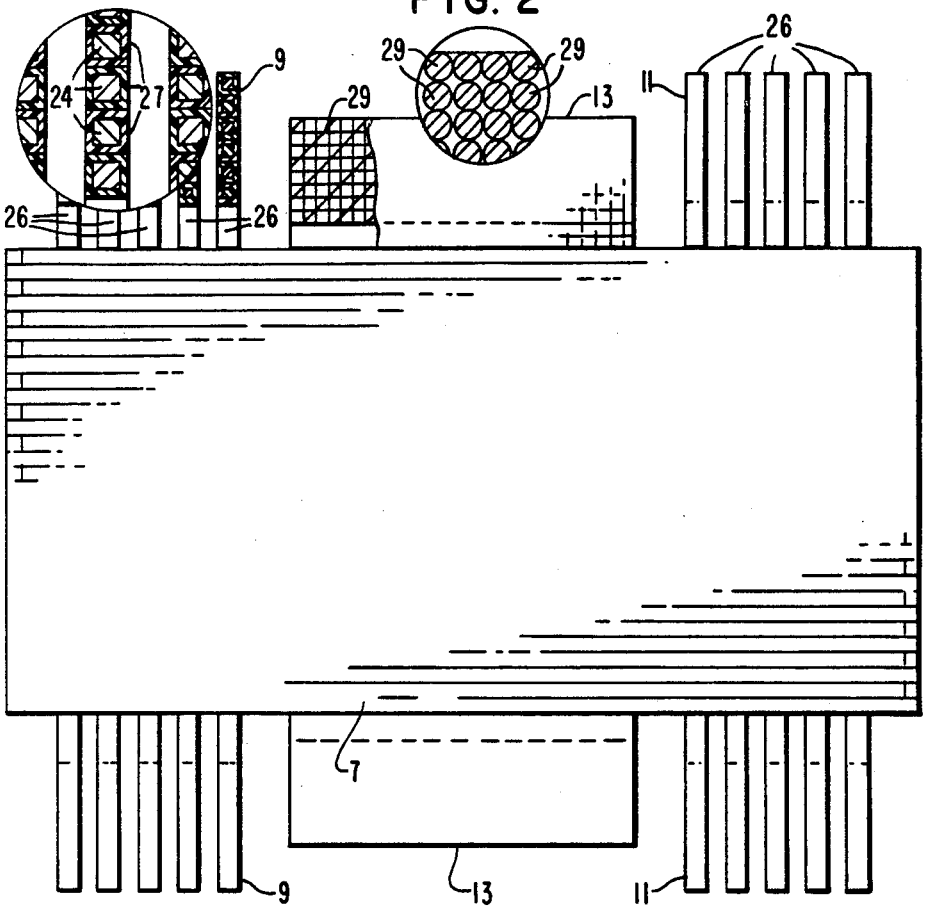
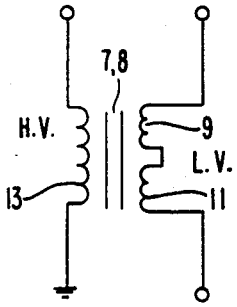
FIG. 3

POWER TRANSFORMER

BACKGROUND OF THE INVENTION

1. Field of the Invention

This invention relates to electrical inductive apparatus, such as transformers, and more particularly to windings for such apparatus.

2. Description of the Prior Art

In electrical inductive apparatus utilizing the shell form type construction, the windings, which are interleaved, are composed of individual coils which are pancake in configuration. The space required within each winding to insulate between the coils and to remove the heat generated during power flow results in an inefficient winding space factor.

Since the windings are composed of individual pancake coils which must be handled separately during assembly, the subdivisions of the conductors within the turns are limited in size reduction due to mechanical strength requirements. The coils must have sufficient strength to allow for individual leads for inefficient power flow through the device because eddy currents, which produce internal losses, are directly proportional to the square of the width of the conductor subdivisions.

The connections between the individual coils, within the windings, further reduce the efficiency of the device because the connections create paths for circulating currents between the conductor subdivisions within each pancake coil.

The eddy currents within each subdivision and the circulating current between subdivisions create losses which reduce the power output in two ways:

1. The losses reduce the operating efficiency; and
2. The losses produce heat which must be removed from the windings and dissipated.

SUMMARY OF THE INVENTION

In accordance with this invention, it has been found that a new and useful concept for reducing the total eddy and circulating current losses in a transformer winding is provided which coprises a shell-form type laminated magnetic core; groups of laterally spaced high and low voltage coils disposed in inductive relationship with the magnetic core and including at least a pair of outer low voltage coils and an intermediate high voltage coil; the low voltage coils having a pancake type winding structure; and the high voltage coil having a plurality of laterally spaced insulated conductor strands spirally wound to provide a plurality of coil layers.

The advantage of the transformer structure of this invention is: (1) the reduction of eddy-current losses due to smaller strands in the high voltage coil, (2) the reduction of circulating current losses due to the elimination of coil to coil connections, (3) a substantial size reduction due to the elimination of coil to coil spaces, (4) improved insulation, and (5) better voltage distribution.

BRIEF DESCRIPTION OF THE DRAWINGS

FIG. 2 is an elevational view partly in section of the coil and core assembly of the invention; and FIG. 3 is a circuit diagram of the coils and core in accordance with this invention.

DESCRIPTION OF THE PREFERRED EMBODIMENT

Figure 1:
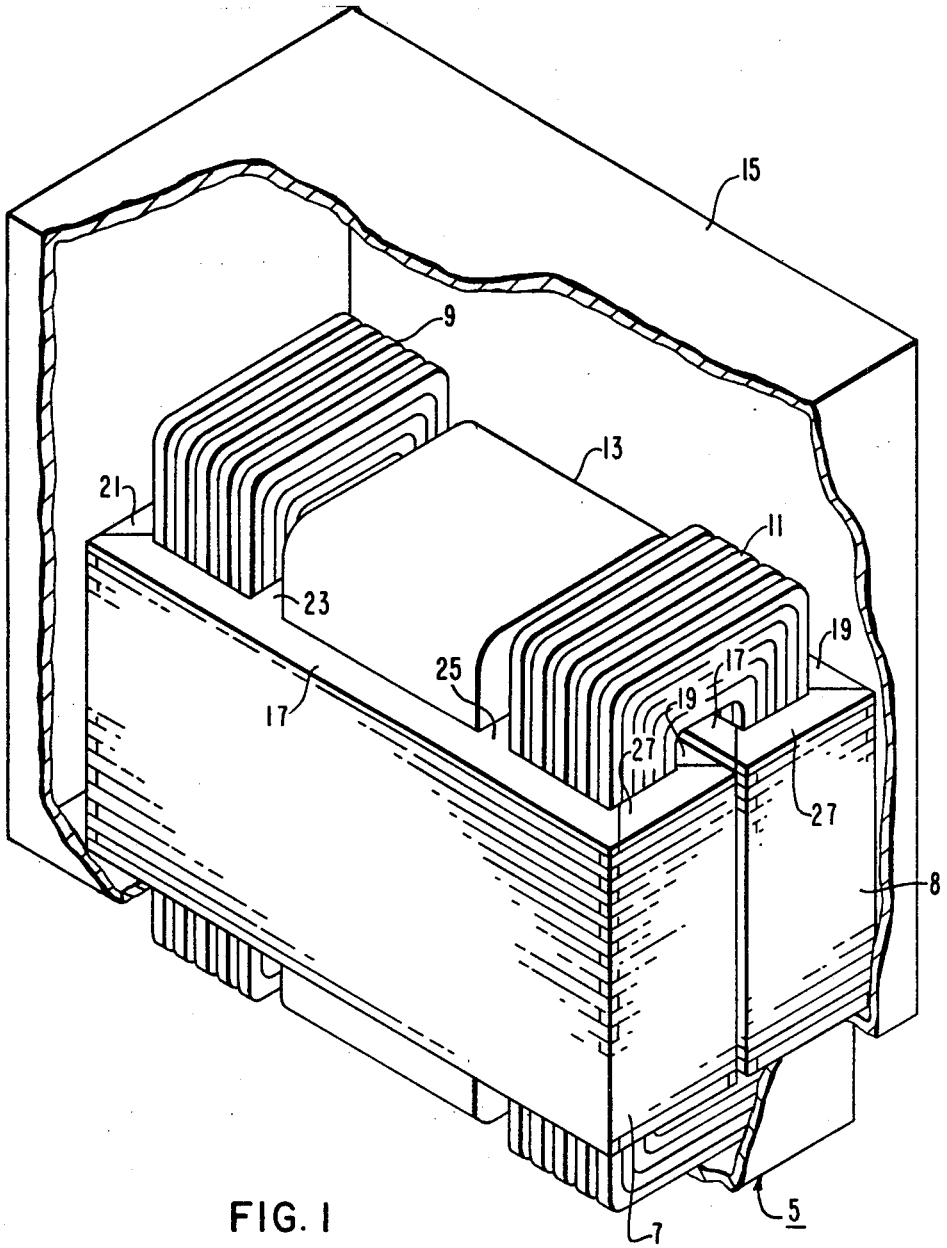
FIG. 1 is a cut-away view of a power transformer in accordance with this invention.

A power transformer is generally indicated at 5 (FIG. 1) and it comprises a coil-core assembly including cores 7 and 8, a pair of low voltage coil groups 9 and 11, and high voltage coil group 13 between the low voltage coil groups. The core-coil assembly is contained within a housing 15. Though the core-coil assembly is a shell-form type of structure, it is understood that the core-form type may also obtain for the purpose of this invention.

The core 7 is a laminated magnetic core including legs 17, 19 as well as yokes 21, 23, 25, 27. The core 8 is comprised of legs and yokes having similar reference numerals for simplicity. The legs and yokes are formed from a plurality of laminations which are assembled around the winding structure or coil groups 9, 11, 13.

The conductors forming the first and second coil groups 9, 11 are comprised of one or more insulated strands 24 (FIG. 2), or layers of strands, forming a plurality of so-called "pancake" coils 26. The strands are transposed within the coils 26 to reduce the effects of leakage flux. Interconnection between the coils 26 within a winding group is shown in FIG. 3 and reference is also made to U.S. Pat. No. 3,688,233 for illustrative purposes. The several strands 24 may be either round or rectangular as shown and have a dimension ranging from about 1/16 inch to about ¼ inch. Each strand 24 in both coil groups 9, 11 is insulated in a conventional manner, such as by being provided with an enamel coating 27.

In accordance with this invention, the high voltage coil 13 has a small turn height and a large turn width compared with the several pancake coils 26. Strands 29 are composed of a plurality of insulated continuously transposed round or rectangular conductors. The winding method may comprise the winding of at least one strand 29 from the left to the right side of the coil structure 13 and then back and forth helically within the right- and left-hand sides of the coil 13. The winding continues continuously for a multitude of turns and layers until the coil 13 is completed at a height less than that of the coils 26. The conductor strands may have a dimension varying in range from 1/64 inch to about 1/16 inch, and more or less 600 strands per layer may be involved, depending upon the gauge of each strand.

Accordingly, the winding space factor for the winding structure is improved due to the lack of coil-to-coil clearances which existed with winding groups of prior construction. The one coil 29 takes the place of a number of coils, that presently used in shell-type windings, as results in a savings in space and materials.

Dielectric advantages include the fact that within the winding group, the only insulation required is turn-to-turn insulation. Since there is only one coil per group, there are no coil-to-coil clearances thereby improving the space factor. Moreover, major insulations are contoured to fit the equipotential lines. Moreover, the impulse distribution through the winding is good due to the high turn-to-turn capacitance. In addition, coil-to-coil connections are eliminated. Also, in the type of coil shown in FIGS. 1 and 2, this type lends itself well to a solid insulation system.

Since the turns are now all in one coil, the individual conductor subdivisions can be much smaller, so as to reduce eddy losses, and still retain the mechanical strength necessary for handling the coil during assembly. The interleaving of the windings produces a leakage flux field which results in magnetic forces which are in the direction of the greatest copper mass. The effect of this mass is to produce very high resistance to the mechanical forces through faults.

The quadrature magnetic forces act to compress the coil resulting in very low hoop stresses. Moreover, "B" stage epoxy or other resins may be used to impregnate each turn to give superior short circuit strength. Finally, additional blocking across the winding group may be used to provide additional short circuit strength where necessary.

What is claimed is:

1. A power transformer comrprising:

a laminated magnetic core;

low voltage coil groups having a pancake-type winding structure disposed in inductive relationship with said core;

a high voltage coil group having a winding structure disposed in inductive relationship with said core and between each pair of low voltage groups;

each low voltage coil group including a plurality of said pancake winding structures; and said high voltage coil group including a plurality of coil layers that are successively formed one upon another by winding a strand of an insulated conductor back and forth between the low voltage coil groups.

2. The device of claim 1 in which said conductor has a gauge smaller than that of the pancake coils.

* * * * *